US009924568B2

(12) United States Patent
Jämsä et al.

(10) Patent No.: US 9,924,568 B2
(45) Date of Patent: Mar. 20, 2018

(54) DIODE LIGHT SOURCE DRIVER

(71) Applicant: Microsoft Technology Licensing, LLC, Redmond, WA (US)

(72) Inventors: Kai Jämsä, Lieto (FI); Pekka Hyppönen, Salo (FI); Samuli Wallius, Turku (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/012,701

(22) Filed: Feb. 1, 2016

(65) Prior Publication Data

US 2017/0223788 A1 Aug. 3, 2017

(51) Int. Cl.
*H05B 33/08* (2006.01)

(52) U.S. Cl.
CPC ..... *H05B 33/0815* (2013.01); *H05B 33/0818* (2013.01); *H05B 33/0845* (2013.01); *H05B 33/0851* (2013.01); *H05B 33/0884* (2013.01)

(58) Field of Classification Search
CPC .... H01S 5/0427; H01S 5/042; H01S 5/06216; H01S 5/4018; H05B 33/0815; H05B 33/0845; H05B 33/0809; H05B 33/089; H05B 33/083; H05B 33/0887; H05B 33/0848; H05B 33/0803; H05B 33/0842; H05B 33/0824; H05B 33/0866
USPC ..... 372/38.07, 38.02, 29.016, 29.023; 315/186, 219, 193
See application file for complete search history.

(56) References Cited

U.S. PATENT DOCUMENTS

| | | | | |
|---|---|---|---|---|
| 4,995,044 | A | 2/1991 | Blazo | |
| 5,406,572 | A | 4/1995 | Chung | |
| 7,120,479 | B2 * | 10/2006 | Chew | A61B 5/14551 315/186 |
| 7,545,839 | B2 | 6/2009 | Giorgi et al. | |
| 8,184,670 | B2 | 5/2012 | Crawford et al. | |
| 8,188,682 | B2 | 5/2012 | Nalbant | |
| 2003/0016711 | A1 * | 1/2003 | Crawford | H01S 5/042 372/38.02 |

(Continued)

FOREIGN PATENT DOCUMENTS

| | | | |
|---|---|---|---|
| EP | 1033903 | A2 | 9/2000 |
| JP | H5175579 | A | 7/1993 |
| WO | 9830070 | A1 | 7/1998 |

OTHER PUBLICATIONS

Thompson, et al., "High Power Laser Diode Driver Based on Power Converter Technology", In Proceedings of IEEE Transactions on Power Electronics, vol. 12, Issue 1, Jan. 1997, pp. 46-52.

(Continued)

*Primary Examiner* — Douglas W Owens
*Assistant Examiner* — Wei Chan

(57) ABSTRACT

An apparatus is disclosed in some embodiments. The apparatus comprising; a diode light source having a first terminal and a second terminal, an input configured to receive power form an output of a power supply, an inductor configured to store energy and to provide power for the diode light source, the inductor having a first terminal connected to the first terminal of the diode light source, and a second terminal connected to the second terminal of the diode light source, wherein the diode light source and the inductor are connected in parallel, a switching element configured to control a flow of a current through the inductor.

20 Claims, 5 Drawing Sheets

(56) References Cited

U.S. PATENT DOCUMENTS

| | | | | |
|---|---|---|---|---|
| 2003/0039280 | A1 | 2/2003 | Mangano et al. | |
| 2004/0160996 | A1* | 8/2004 | Giorgi | H01S 5/042 372/25 |
| 2006/0291512 | A1 | 12/2006 | Borschowa | |
| 2009/0179575 | A1* | 7/2009 | Mednik | H05B 33/0818 315/193 |
| 2009/0201052 | A1 | 8/2009 | Sanduleanu et al. | |
| 2010/0213857 | A1* | 8/2010 | Fan | H05B 33/0827 315/186 |
| 2012/0189028 | A1* | 7/2012 | Hoffman | H01S 5/4018 372/38.07 |
| 2013/0002162 | A1* | 1/2013 | Gao | H05B 33/0815 315/210 |
| 2013/0119881 | A1 | 5/2013 | Fang et al. | |
| 2014/0231243 | A1 | 8/2014 | Finley | |

OTHER PUBLICATIONS

"International Search Report & Written Opinion Issued in PCT Application No. PCT/US2017/013683", dated Mar. 30, 2017, 13 Pages.

"Second Written Opinion Issued in PCT Application No. PCT/US2017/013683", dated Oct. 12, 2017, 7 Pages.

* cited by examiner

DIODE LIGHT SOURCE DRIVER

BACKGROUND

Diode light sources may be used in a variety of applications. For example, diode light sources may be used for illumination, distance measurement, precision cutting and etching, security applications, communication etc. For optimal performance, driver circuits may be used to provide power and operate diode light sources. To prevent damage or due to other design and engineering concerns, a diode light source's operation may be pulsed so that it alternates between an on and an off state. A pulsed diode light source driver circuit and hence the diode light source has multiple components and their parasitic inductances. Switching frequency of a diode light source may be affected by residual currents due to these parasitic inductances.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

A driver for diode light sources is described. In an embodiment, an apparatus is disclosed. The apparatus comprising; a diode light source having a first terminal and a second terminal, an input configured to receive power form an output of a power supply, an inductor configured to store energy and to provide power for the diode light source, the inductor having a first terminal connected to the first terminal of the diode light source, and a second terminal connected to the second terminal of the diode light source, wherein the diode light source and the inductor are connected in parallel, and a switching element configured to control a flow of a current through the inductor.

In other embodiments, an apparatus and a method are discussed.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like references are used to designate like parts in the accompanying drawings.

DETAILED DESCRIPTION

The detailed description provided below in connection with the appended drawings is intended as a description of the embodiments and is not intended to represent the only forms in which the present embodiments may be constructed or utilized. However, the same or equivalent functions and structures may be accomplished by different embodiments.

Although the embodiments may be described and illustrated herein as being implemented to drive and operate a laser diode, this is only an example of a diode light source and not a limitation. As those skilled in the art will appreciate, the present embodiments are suitable for application in a variety of different types of diode light sources and/or pulsed light sources, for example LEDs.

Figure 1:
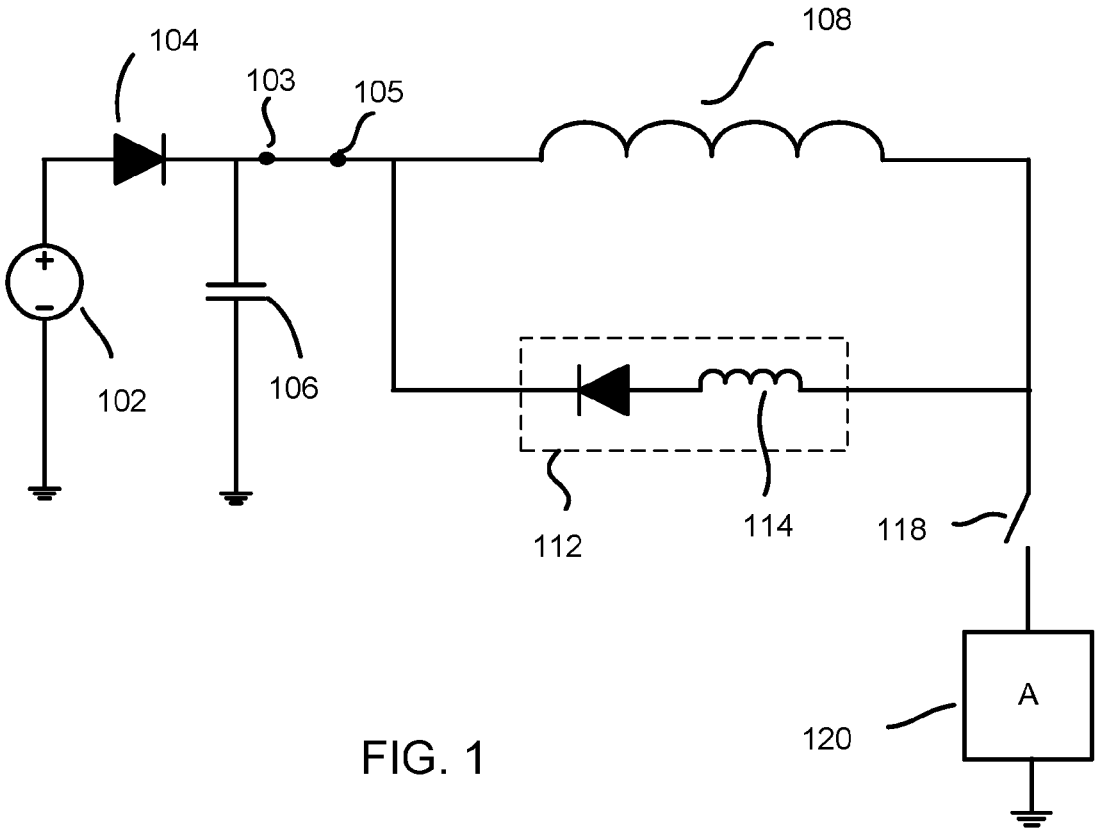
FIG. 1 illustrates a schematic representation of a driver circuit for a laser diode according to an embodiment.

FIG. 1 illustrates a driver circuit for an LED or a laser diode according to an embodiment. The circuit may include a power IN terminal 105, inductor 108 such as a coil, switch 118, current limiter 120, a laser diode 112 comprising a parasitic inductance 114. The inductor 108 is in parallel to the laser diode 112. Further, the power supply may comprise a voltage source 102, a diode 104 and a capacitor 106 in parallel to the voltage source 102 and a power OUT terminal 103.

Referring to FIG. 1, the power source may comprise a voltage source 102 having two terminals, one connected to an electrical ground and another to the first terminal of diode 104. The second terminal of diode 104 may be connected to power OUT terminal 103 and a terminal of capacitor 106. The other terminal of capacitor 106 may be connected to an electrical ground. Inductor 108 may be connected to power IN 105 on one end and to switch 118 on the other end. The laser diode 112 comprises two terminals: anode and cathode. Each terminal of the laser diode 112 may be connected to a terminal of the inductor 108, such that the inductor 108 is parallel to the laser diode 112. Its cathode may be connected to the terminal of inductor 108 which is connected to power IN terminal 105 while its anode may be connected to the other terminal of inductor 108 and to the switch 118. Furthermore, the laser diode 112 is reverse biased when switch 118 is closed. According to another embodiment, the power source may comprise a current source (not shown in FIG. 1).

Referring to FIG. 1, when the switch 118 is closed, the diode 104 may be reverse biased and current may flow through the inductor 108 and the current limiter 120 to ground. Further this current flow may reverse bias the laser diode 112, preventing any current flow through it. Current flow in the inductor 108 may build up till a desired value is reached. According to an embodiment, this desired value may be equal to the steady/saturation state current through the inductor 108. Reaching desired current levels may ensure that a certain amount of energy is stored in inductor 108. When the switch 118 is opened, a voltage may develop across the inductor 108 in accordance with Lenz's law, forward biasing the laser diode 112 and thus turning it on. After a desirable time period, the switch 118 may be closed again. Now the voltage across the inductor 108 may again reverse in accordance with Lenz's law. This may reverse bias the laser diode 112 and terminate current flow through it, overcoming residual current flow, if any, caused due to the kick back voltage in parasitic inductance 114. The kick back voltage in parasitic inductance 114 may be in accordance with Lenz's law.

When the switch 118 is closed, energy is stored in the inductor 108. When the switch is opened, the energy may be released from the inductor 108 for the laser diode 112. Consequently, the energy of the inductor 108 is used to generate enough voltage for fast switching the parallel connected laser diode 112. When switching, the polarity of the voltage of the laser diode 112 is reversed. When the switch 108 is closed, voltage is higher at the power IN 105 than at a terminal of the switch 118. When the switch is opened, the voltage is higher at the terminal of the switch 118 than at the power IN 105. When the switch 118 is opened, current rotates via the laser diode 112 and the inductor 108 loop. A current regulator 120 is used to set the current level of the inductor 108 at a desired level.

According to an embodiment, the reverse bias across a laser diode 112 occurring when a switch 118 is closed may terminate current in the laser diode 112 faster than, for example, in absence of a reverse bias. According to an embodiment, this faster termination of current through a laser diode 112 may allow faster switching of the laser diode 112. Because the change of the polarity of the voltage of the laser diode 112, the switching off is fast. According to an embodiment, faster switching without using any resistors may lead to more energy efficiency. According to an embodiment, a laser diode 112 may be driven at a higher voltage than provided by a voltage source 102. According to an embodiment, a driver circuit may be simplified by using only one switch 118, which may reduce the parasites of the circuit. The switching off process may be considered as an active process, since the energy of the inductor 108 is used for fast switch off. The inductor 108 may also speed up the switching on process, especially for high frequencies.

Figure 2:
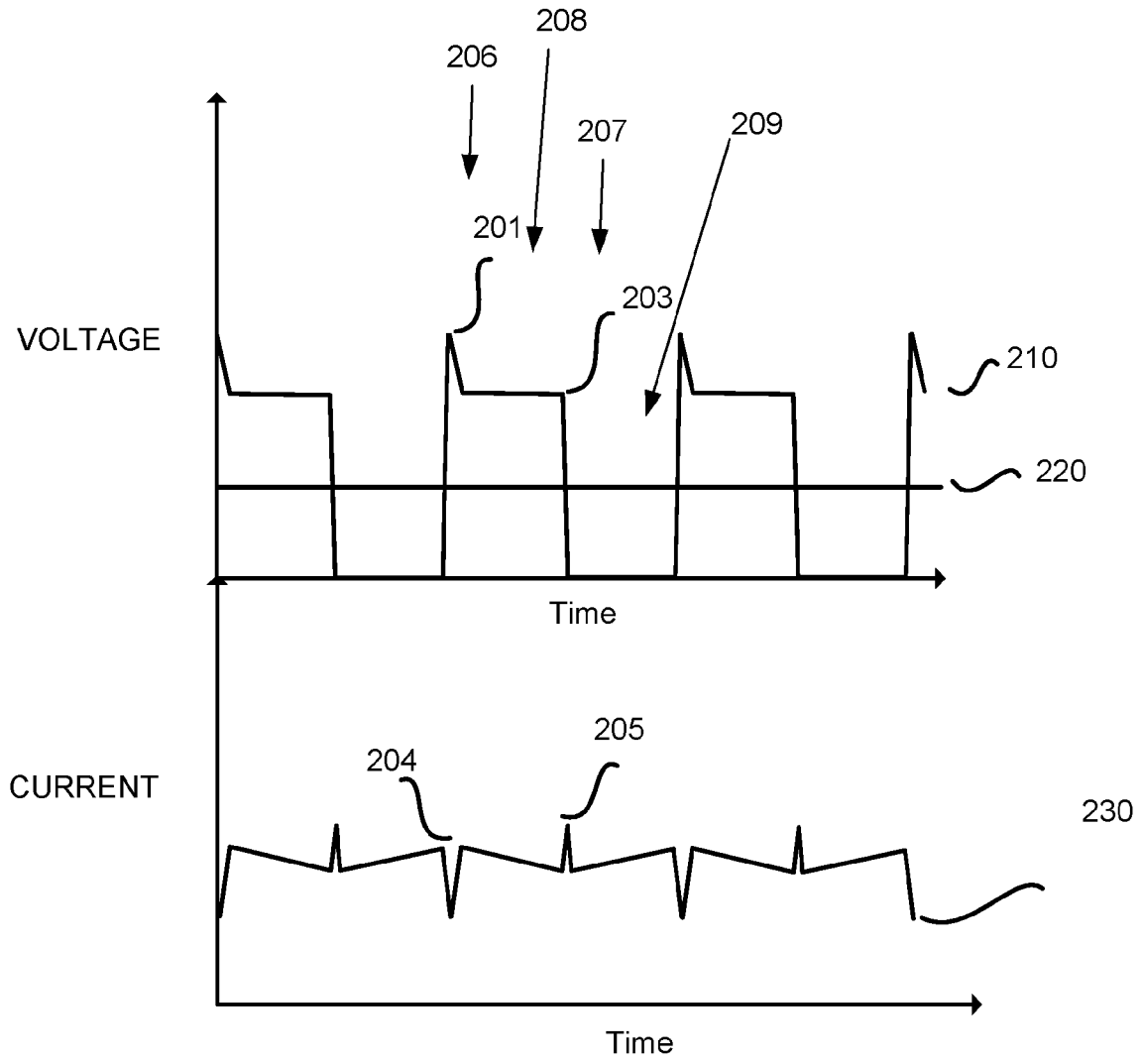
FIG. 2 illustrates a graphical representation of voltage across a laser diode and current through an inductor of the driver circuit according to an embodiment.

FIG. 2 graphically illustrates the voltage levels across laser diode 112 and current levels through inductor 108 comprising the driver circuit of an embodiment illustrated in FIG. 1. Waveform 210 represents the voltage level across the laser diode 112 during operation, line 220 is the voltage level as provided by voltage source 102. Waveform 230 represents the current levels through inductor 108 during operation. At the instant 206 switch 118 is opened, an instantaneous voltage surge 201 may occur across the laser diode 112, which may correspond to an instantaneous current trough 204 in the current running through the inductor 108. At the instant 207 the switch 118 is closed, a steep change 203 in voltage polarity may occur across the laser diode 112, and a corresponding a current surge 205 may occur in the inductor 108. During a period 208 when the current of the laser diode 112 is ON, the current decrease depends on a value of the inductor 108. During a period 209 when the current of the laser diode 112 is OFF and the current of the inductor 108 is increasing, a peak current is set by the current regulator 120.

A pulse shape of the laser diode 112 may substantially correspond to a rectangular pulse shape, for example due to the active switching off of the laser diode 112. The tail of the pulse may be steepened.

Figure 3:
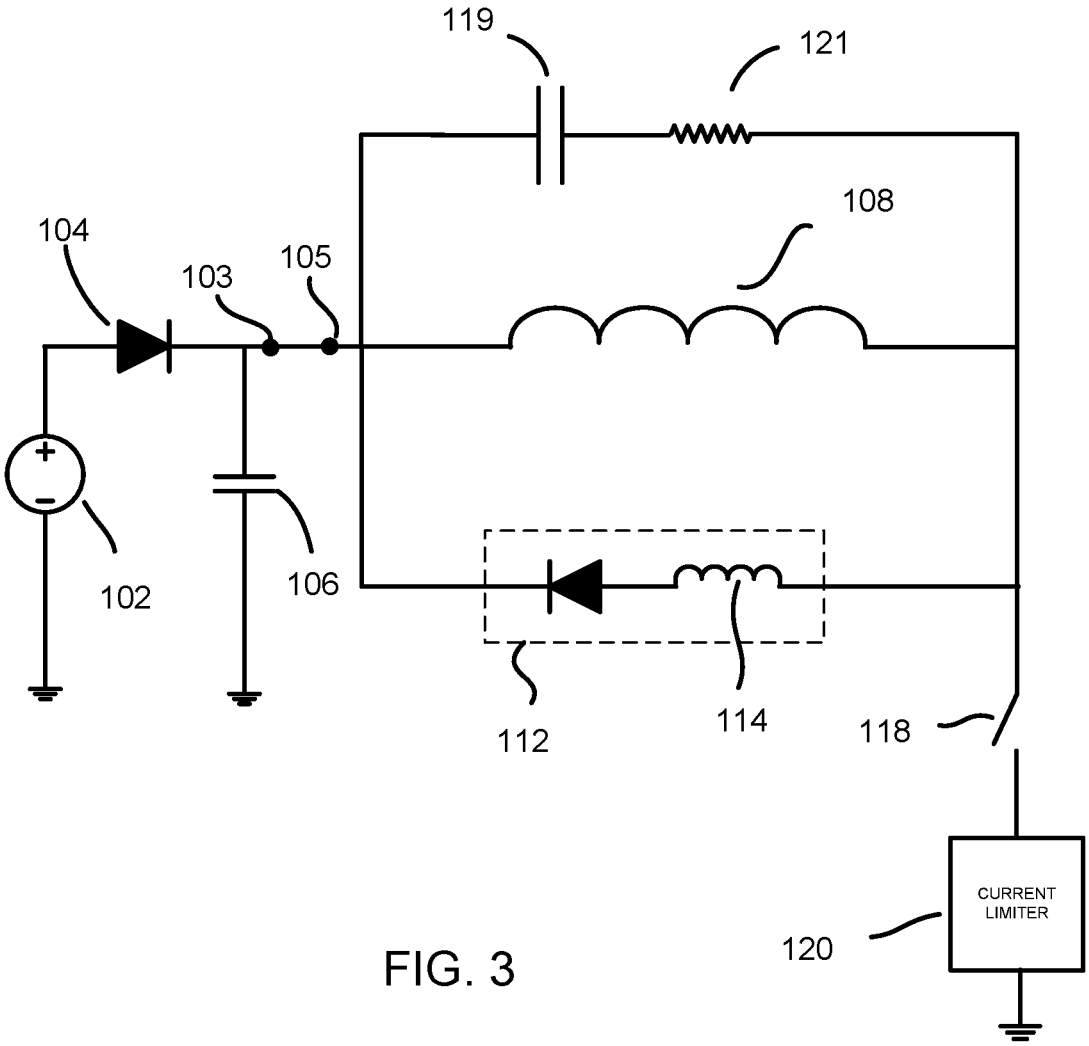
FIG. 3 illustrates a schematic representation of a driver circuit for a laser diode comprising a capacitor to smoothen current flow through an inductor of the driver, according to an embodiment.

FIG. 3 illustrates a schematic representation of a driver circuit for a laser diode 112 according to an embodiment. It may comprise a voltage source 102, a diode 104, a capacitor 106 and a power OUT terminal 103. Further the circuit comprises a power IN terminal 105, a laser diode 112, an inductor 108, a capacitor 119, a resistor 121, a switch 118, and a current limiter 120.

Referring to FIG. 3 diode 104 may have two terminals: anode and cathode, the anode may be connected to a positive terminal of a voltage source 102, while the cathode to power OUT terminal 103. Capacitor 106 may have two terminals, one being connected to a power OUT terminal 103 and the other electrically grounded. Inductor 108 may have two terminals, one connected to power IN 105 and other connected to current limiter 120 through switch 118. Current limiter 120 may be grounded on its other end. Laser Diode 112 may have two terminals, anode and cathode. Its cathode may be connected to the terminal of inductor 108 which is connected to power IN terminal 105 while its anode may be connected to the other terminal of inductor 108. Capacitor 119 and resistor 121 may be connected in series with each other, that is, one terminal of the capacitor 119 may be connected to one terminal of the resistor 121. The other terminal of capacitor 119 may be connected to one terminal of inductor 108 and the other terminal of the resistor 121 may be connected to the second terminal of inductor 108. The capacitor 119 and the resistor 121 are in parallel to the inductor 108.

Referring to FIG. 3, when switch 118 is closed, diode 104 may be reverse biased and current may flow through inductor 108 and current limiter 120 to ground. Further this current flow may reverse bias the laser diode 112 as its cathode is at a higher voltage than its anode. Current flow in 108 may build up till a desired value is reached. According to an embodiment, this desired value may be equal to the steady state current through inductor 108. Reaching desired current levels may ensure that a certain amount of energy is stored in inductor 108. Further, capacitor 119 may get charged to a desired level. When switch 118 is opened, a voltage may develop across inductor 108 in accordance with Lenz's law, forward biasing the laser diode and thus turning it on. Capacitor 119 may also start discharging. After a desirable time period, switch 118 may be closed again. Now the voltage across inductor 108 may reverse so as to maintain flow of current in the same direction. This may reverse bias the laser diode 112 and terminate current flow through it, overcoming residual current flow, if any, caused due to the kick back voltage in parasitic inductance 114. The kick back voltage in parasitic inductance 114 may be in accordance with Lenz's law. According to an embodiment, capacitor 119 and resistor 121 may be chosen such that any current surges 205 and troughs 204 occurring in the inductor 108 are substantially smoothened out.

Figure 4:
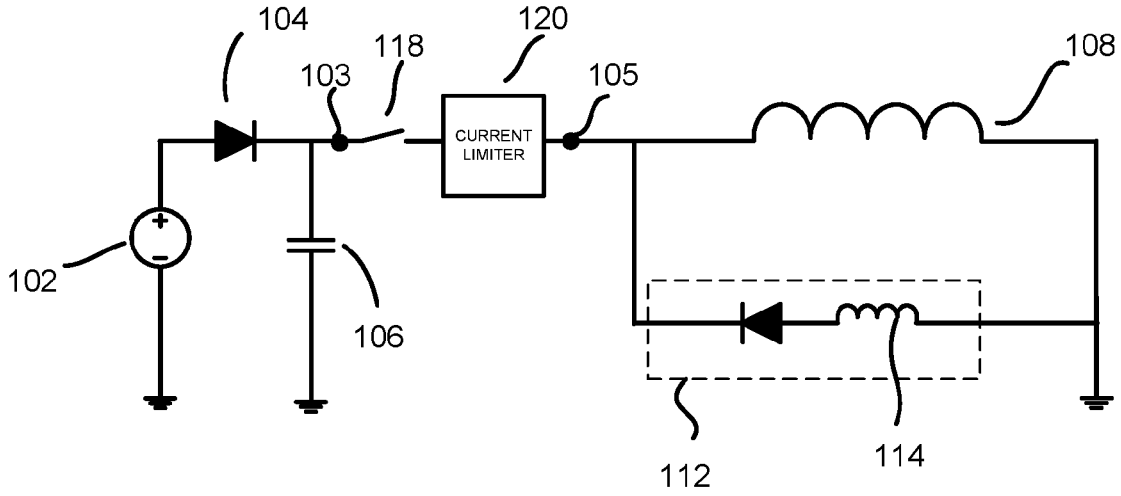
FIG. 4 illustrates a schematic representation of a driver circuit for a laser diode in which the current limiter and the switch is configured in between the output of a power supply and input of the driver circuit, according to an embodiment.

FIG. 4 illustrates a schematic representation of a circuit for driving a laser diode, according to an embodiment. The circuit may include a power IN terminal 105, inductor 108, switch 118, current limiter 120, and a laser diode 112 comprising a parasitic inductance 114. The inductor 108 is in parallel to the laser diode 112. Further the power supply may comprise a voltage source 102, a diode 104 and a capacitor 106 in parallel to the voltage source 102 and a power OUT terminal 103.

Referring to FIG. 4, voltage source 102 may be connected to a power OUT terminal 103 through a diode 104. Capacitor 106 may be connected to the power OUT terminal 103 at one end and to an electrical ground on the other end. Switch 118 may be connected to power OUT terminal 103 on one end and current limiter 120 on the other end. Current limiter 120 may be connected to power IN terminal 105. Inductor 108 may be connected at one end to the power IN terminal 105 at one end and to the ground at its other end. Laser diode 112 may be connected in parallel to the inductor 108, such that its cathode is connected to power IN terminal 105. Anode of the laser diode 112 is connected to the ground.

Figure 5:
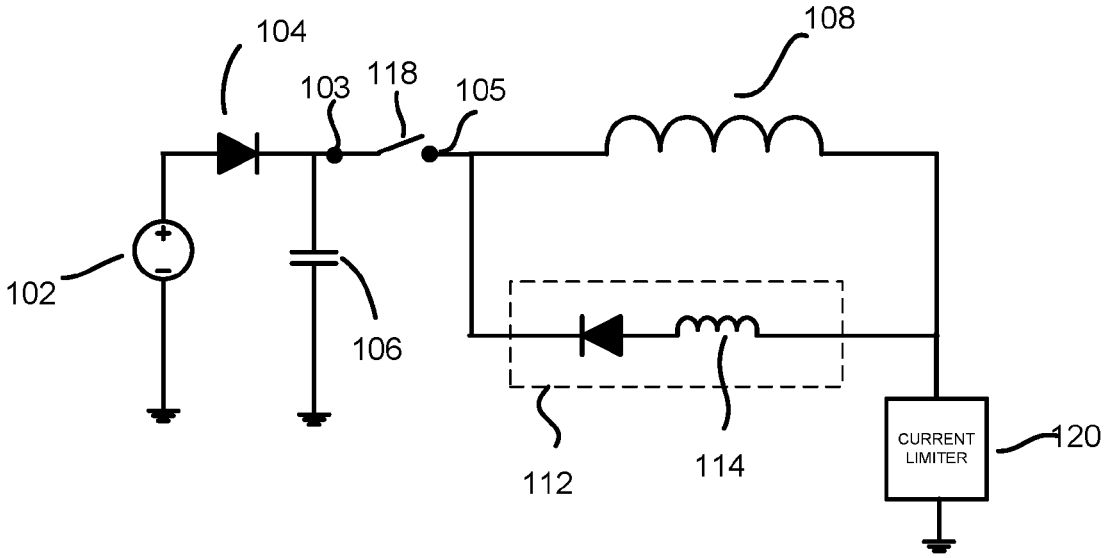
FIG. 5 illustrates a schematic representation of a driver circuit for a laser diode in which the switch is configured in between the output of a power supply and input of the driver circuit, according to an embodiment.

FIG. 5 illustrates a schematic representation of a circuit for driving a laser diode according to an embodiment. The topology the circuit illustrated in FIG. 5 may be similar to the topology of FIG. 4 according to an embodiment, except for the location of current limiter 120. Referring to FIG. 5, the switch may be positioned in such that it is connected to inductor 108 and diode 112 at one end and to an electrical ground at other end. A current limiter 120 is connected to the ground at one end and to the inductor 108 and the laser diode 112 at the other end.

Referring to FIG. 4 and FIG. 5, when switch 118 is closed, diode 104 may be forward biased and current may start flowing through inductor 108 and then current limiter 120 to ground. Further this current flow may reverse bias the laser diode 112 as its cathode is at a higher voltage than its anode. Current flow in 108 may build up till a desired value is reached. According to an embodiment, this desired value may be equal to the steady state current through inductor 108. After the desired current levels are reached, a certain amount of energy may be stored in inductor 108. When switch 118 is opened, a voltage may develop across inductor 108 in accordance with Lenz's law, forward biasing the laser diode and thus turning it on. After a desirable time period, switch 118 may be closed again. Now the voltage across inductor 108 may reverse so as to maintain flow of current in the same direction. This may reverse bias the laser diode 112 and terminate current flow through it, overcoming residual current flow, if any, caused due to the kick back voltage in parasitic inductance 114. The kick back voltage in parasitic inductance 114 may be in accordance with Lenz's law.

According to an embodiment, topologies of the driver circuits illustrated in FIG. 4 and FIG. 5 may allow more freedom design, layout and manufacture of the driver circuit.

Diode light sources may be used in a variety of applications. For example, diode light sources may be used for illumination, distance measurement, precision cutting and etching, security applications, communication etc. According to an embodiment, the apparatus may operate as a flashlight having an oscillator in connection or in addition to the switch 118.

Figure 6:
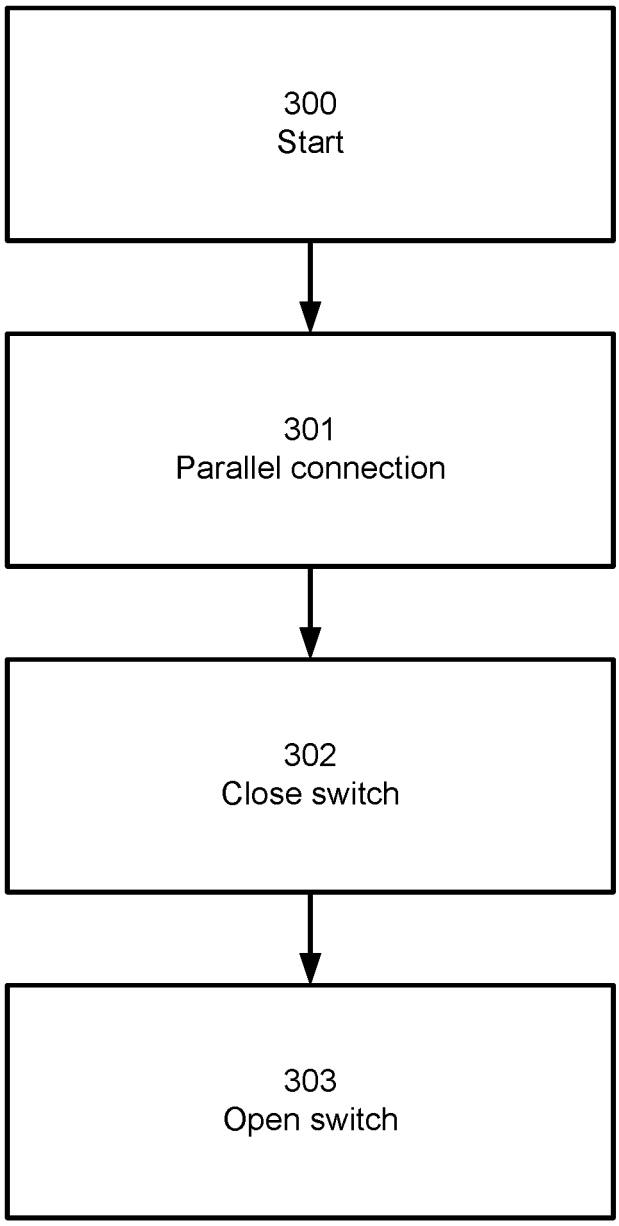
FIG. 6 illustrates a schematic flow chart of a method of driving a laser diode in accordance with an embodiment.

FIG. 6 illustrates, as a schematic flow chart, a method of driving a laser diode 112 in accordance with an embodiment. Referring to FIG. 6, according to an embodiment the process may comprise operations. According to an embodiment, at least some part or parts of the process of FIG. 6 may be compiled into a program code to be executed by a processor, microcontroller or any other computing apparatus or any other device capable of executing instructions.

Operation 300 may comprise providing a power source connected to an inductor 108, the inductor 108 being connected by a switch 118 to an electrical ground.

Operation 301 may comprise connecting the laser diode 112 to be driven in parallel to the inductor 108 of the switch 118 of operations 300 such that the laser diode 112 stays reverse biased, when the inductor draws power and/or current from the power source. This may be accomplished, for example, by connecting the cathode of the laser diode 112 to a positive power OUT terminal of a power source. Anode of the laser diode 112 may be connected to the ground. Inductor 108 is in parallel to the laser diode 112.

Operation 302 may comprise closing the switch for a time period, the time period being sufficiently long to allow a desired current level to build up in the inductor 108.

Operation 303 may comprise opening the switch to allow current flowing through the inductor 108 due to Lenz's law to loop through the laser diode 112 consequently turning it on.

According to an embodiment, the opening and closing of the switch 118 may be controlled by a logic circuit (not shown in the figures), which may open and close the switch 118 based upon current levels in the inductor 108 as measured by a current limiter 120 and/or user preferences as specified by a user through an input means. The user may specify, for example, a duty cycle or a switching frequency. According to an embodiment, the switching frequency may be up to hundreds of mega Hertz.

At least some part of the methods and functionalities described herein may be performed by software in machine readable form on a tangible storage medium e.g. in the form of a computer program comprising computer program code means adapted to perform all the functions and the operations of any of the methods described herein when the program is run on a computer and where the computer program may be embodied on a computer readable medium. Examples of tangible storage media include computer storage devices comprising computer-readable media such as disks, thumb drives, memory etc. and do not include propagated signals. Propagated signals may be present in tangible storage media, but propagated signals per se are not examples of tangible storage media. The software can be suitable for execution on a parallel processor or a serial processor such that the method operations may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store, parts or all of, an example of the process described as software. A local or terminal computer may access the remote computer and download a part or all of the software to run the program. Alternatively, the local computer may download pieces of the software as needed, or execute some software instructions at the local terminal and some at the remote computer (or computer network). Alternatively, or in addition, the functionally described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

Any range or device value given herein may be extended or altered without losing the effect sought. Also any embodiment may be combined with another embodiment unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

An embodiment relates to an apparatus, comprising: a diode light source having a first terminal and a second terminal; an input configured to receive power from an output of a power supply; an inductor configured to store energy and to provide power to the diode light source, the inductor having a first terminal connected to the first terminal of the diode light source, and a second terminal connected to the second terminal of the diode light source, wherein the inductor and the diode light source are connected in parallel; and a switching element configured to control a flow of a current through the inductor.

According to an embodiment alternatively or in addition to the above, the diode light source comprises a light emitting diode.

According to an embodiment alternatively or in addition to the above, the diode light source comprises a laser diode.

According to an embodiment alternatively or in addition to the above, the switching element has at least two states, one state allowing current to flow into the inductor from the power supply and the other state disallowing it.

According to an embodiment alternatively or in addition to the above, when the switching element is turned into an ON state, current starts building up in the inductor and the diode light source is reverse biased, terminating current flow through the diode light source.

According to an embodiment alternatively or in addition to the above, when the switching element is turned into an OFF state, current continues to flow through the inductor and completes a loop through the diode light source, and the diode light source is forward biased.

According to an embodiment alternatively or in addition to the above, further comprising a capacitor and a resistor each having a first terminal and a second terminal, the first terminal of the capacitor being connected to the first terminal of the inductor, the second terminal of the capacitor being connected to the first terminal of the resistor and the second terminal of the resistor being connected to the second terminal of the inductor, wherein the capacitor and the resistor are in parallel to the inductor.

According to an embodiment alternatively or in addition to the above, the capacitor is configured to smoothen the current flowing through the inductor.

According to an embodiment alternatively or in addition to the above, the switch is selected from the group comprising: field effect transistor, FET, metal oxide semiconductor field effect transistor MOSFET.

According to an embodiment alternatively or in addition to the above, the first terminal of the inductor and the first terminal of the diode light source are connected to the input, and the second terminal of the inductor and the second terminal of the diode light source are connected to the switching element.

According to an embodiment alternatively or in addition to the above, the switching element is connected in between the input and the inductor, the first terminal of the inductor and the first terminal of the diode light source are connected to the switching element, and the second terminal of the inductor and the second terminal of the diode light source is connected to the ground.

According to an embodiment alternatively or in addition to the above, the switching element comprises a switch and a current limiter, and the first terminal of the inductor and the first terminal of the diode light source are connected to the switch, and the second terminal of the inductor and the second terminal of the diode light source are connected to the current limiter.

An embodiment relates to an apparatus, comprising: a diode light source having a first terminal and a second terminal; an input configured to receive power form an output of a power supply; an inductor configured to store energy and to provide power for the diode light source, the inductor having a first terminal connected to the first terminal of the diode light source, and a second terminal connected to the second terminal of the diode light source, wherein the inductor and the diode light source are connected in parallel; a current limiter configured to limit current flowing through the inductor; and a switch configured to allow and disallow current flow from the power supply through the inductor to a ground.

According to an embodiment alternatively or in addition to the above, the current limiter is connected to the switch at one end and to the ground on the other end, the switch being connected to the inductor.

According to an embodiment alternatively or in addition to the above, the current limiter and the switch are connected in between the output of the power supply and the input of the apparatus and the second terminal of the inductor is connected to the ground in addition to the second terminal of the diode light source.

According to an embodiment alternatively or in addition to the above, the current limiter is connected in between the output of the power supply and the input of the apparatus, while the second terminal of the inductor is connected to the switch in addition to the second terminal of the diode light source and the switch is connected to a ground.

According to an embodiment alternatively or in addition to the above, the current limiter controls the switch, turning it off when the current in the inductor has reached a preset value.

According to an embodiment alternatively or in addition to the above, further comprising a capacitor and a resistor each having a first terminal and a second terminal, the first terminal of the capacitor being connected to the first terminal of the inductor, the second terminal of the capacitor being connected to the first terminal of the resistor and the second terminal of the resistor being connected to the second terminal of the inductor.

An embodiment relates to a method of driving a diode light source, comprising: providing a power source connected to an inductor; connecting the diode light source in parallel to the inductor, such that the diode light source is reverse biased when the inductor draws current from the power source and a switch is open; closing the switch to allow current to build up in the inductor; and opening the switch, so that current flowing through the inductor loops through the diode light source.

According to an embodiment alternatively or in addition to the above, the opening and closing of the switch is based on the current levels through the inductor.

An embodiment relates to an apparatus, comprising: a diode light source means having a first terminal means and a second terminal means; an input means for receiving power from an output means of a power supply means; an inductor means for storing energy and providing power to the diode light source means, the inductor means having a first terminal means connected to the first terminal means of the diode light source means, and a second terminal connected to the second terminal of the diode light source means, wherein the inductor means and the diode light source means are connected in parallel; and a switching element means for controlling a flow of a current through the inductor means.

An embodiment relates to an apparatus, comprising: a diode light source means having a first terminal means and a second terminal means; an input means for receiving power form an output means of a power supply means; an inductor means for storing energy and to provide power for the diode light source means, the inductor means having a first terminal means connected to the first terminal means of the diode light source means, and a second terminal means connected to the second terminal means of the diode light source means, wherein the inductor means and the diode light source means are connected in parallel; a current limiter means for limiting current flowing through the inductor means; and a switch means for allowing and disallowing current flow from the power supply means through the inductor means to a ground means.

An embodiment relates to an apparatus of driving a diode light source means, comprising: means for providing a power source connected to an inductor; means for connecting the diode light source in parallel to the inductor, such that the diode light source is reverse biased when the inductor draws current from the power source and a switch is open; means for closing the switch to allow current to build up in the inductor; and means for opening the switch, so that current flowing through the inductor loops through the diode light source.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The operations of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method, blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. An apparatus comprising:

an input configured to receive power from an output of a power supply;

a diode light source having a cathode terminal and an anode terminal, wherein the cathode terminal of the diode light source is connected to the input;

an inductor configured to store energy and to provide power to the diode light source, the inductor having a first terminal connected to the cathode terminal of the diode light source, and a second terminal connected to the anode terminal of the diode light source, wherein the inductor and the diode light source are connected in parallel, and wherein the first terminal of the inductor is connected to the input;

a capacitor and a resistor each having a first terminal and a second terminal, the first terminal of the capacitor being connected to the first terminal of the inductor, the second terminal of the capacitor connected to the first terminal of the resistor, and the second terminal of the resistor connected to the second terminal of the inductor, wherein the capacitor and the resistor are in parallel to the inductor;

a switching element configured to control a flow of a current through the inductor, wherein the switching element is connected to the second terminal of the inductor and the anode terminal of the diode light source; and a current limiter configured to open the switching element when the current limiter detects a preset value of current in the inductor, wherein the current limiter is connected to the switching element at one end and to ground on another end.

2. The apparatus according to claim 1, wherein the diode light source comprises a light emitting diode.

3. The apparatus according to claim 1, wherein the diode light source comprises a laser diode.

4. The apparatus of claim 1, wherein the switching element has at least two states, one state allowing current to flow into the inductor from the power supply and the other state disallowing it.

5. The apparatus of claim 1, wherein when the switching element is turned into an ON state, current starts building up in the inductor and the diode light source is reverse biased, terminating current flow through the diode light source.

6. The apparatus of claim 1, wherein when the switching element is turned into an OFF state, current continues to flow through the inductor and completes a loop through the diode light source, and the diode light source is forward biased.

7. The apparatus according to claim 1, wherein the current limiter turns the switching element off when the current in the inductor has reached a second preset value.

8. The apparatus according to claim 1, wherein the capacitor is configured to smoothen the current flowing through the inductor.

9. The apparatus according to claim 1, wherein the switching element is selected from the group comprising: field effect transistor, FET, metal oxide semiconductor field effect transistor MOSFET.

10. The apparatus of claim 1, wherein the first terminal of the inductor and the cathode terminal of the diode light source are connected to the input, and the second terminal of the inductor and the anode terminal of the diode light source are connected to the switching element.

11. The apparatus of claim 1, wherein the switching element is connected in between the input and the inductor, the first terminal of the inductor and the cathode terminal of the diode light source are connected to the switching element, and the second terminal of the inductor and the anode terminal of the diode light source is connected to the ground.

12. The apparatus of claim 1, wherein the switching element comprises a switch and the current limiter, and the first terminal of the inductor and the cathode terminal of the diode light source are connected to the switch, and the second terminal of the inductor and the anode terminal of the diode light source are connected to the current limiter.

13. An apparatus, comprising:

a diode light source having a cathode terminal and an anode terminal;

an input configured to receive power form an output of a power supply;

an inductor configured to store energy and to provide power for the diode light source, the inductor having a first terminal connected to the cathode terminal of the diode light source, and a second terminal connected to the anode terminal of the diode light source, wherein the first terminal of the inductor is connected to the input;

a capacitor and a resistor each having a first terminal and a second terminal, the first terminal of the capacitor being connected to the first terminal of the inductor, the second terminal of the capacitor connected to the first terminal of the resistor, and the second terminal of the resistor connected to the second terminal of the inductor, wherein the capacitor and the resistor are in parallel to the inductor;

a switch configured to allow and disallow current flow from the power supply through the inductor to a ground, wherein the switching element is connected to the second terminal of the inductor and the anode terminal of the diode light source; and a current limiter configured to open the switch when the current limiter detects a preset value of current in the inductor, wherein the current limiter is connected to the switch at one end and to ground on another end.

14. The apparatus of claim 13, wherein the current limiter is connected to the switch at one end and to the ground on the other end, the switch being connected to the inductor.

15. The apparatus of claim 13, wherein the current limiter and the switch are connected in between the output of the power supply and the input of the apparatus and the second terminal of the inductor is connected to the ground in addition to the second terminal of the diode light source.

16. The apparatus of claim 13, wherein the current limiter is connected in between the output of the power supply and the input of the apparatus, while the second terminal of the inductor is connected to the switch in addition to the anode terminal of the diode light source and the switch is connected to a ground.

17. The apparatus of claim 13, wherein the current limiter controls the switch, turning it off when the current in the inductor has reached a preset value.

18. The apparatus according to claim 13, wherein the switch is selected from the group comprising: field effect transistor, FET, metal oxide semiconductor field effect transistor MOSFET.

19. A method of driving a diode light source, comprising:

providing a power source connected to an inductor;

connecting the diode light source in parallel to the inductor, a capacitor, and a resister, wherein the capacitor and the resister are connected in series such that the inductor is configured to store energy and to provide power for the diode light source, and such that the diode light source is reverse biased when the inductor draws current from the power source and a switch is open;

connecting the switch in series to the diode light source, the inductor, the capacitor, and the resister;

connecting a current limiter between the switch and an electrical ground;

closing the switch to allow current to build up in the inductor; and opening the switch when the current limiter detects a preset value of current in the inductor, so that current flowing through the inductor loops through the diode light source.

20. A method according to claim 19, wherein the opening and closing of the switch is based on the current levels through the inductor.

* * * * *